US011462844B2

(12) United States Patent
Kajiura et al.

(10) Patent No.: US 11,462,844 B2
(45) Date of Patent: Oct. 4, 2022

(54) FFC CONNECTOR WITH ANTI-OVERSTRESS FEATURES

(71) Applicant: Amphenol FCI Asia Pte. Ltd., Singapore (SG)

(72) Inventors: Motomu Kajiura, Tokyo (JP); Yasutoshi Kameda, Kisarazu (JP)

(73) Assignee: Amphenol FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 16/953,520

(22) Filed: Nov. 20, 2020

(65) Prior Publication Data

US 2021/0159620 A1 May 27, 2021

Related U.S. Application Data

(60) Provisional application No. 62/939,458, filed on Nov. 22, 2019.

(51) Int. Cl.
*H01R 12/70* (2011.01)
*H01R 12/77* (2011.01)

(52) U.S. Cl.
CPC ..... *H01R 12/7023* (2013.01); *H01R 12/7058* (2013.01); *H01R 12/7064* (2013.01); *H01R 12/774* (2013.01)

(58) Field of Classification Search
None
See application file for complete search history.

(56) References Cited

U.S. PATENT DOCUMENTS

| | | | | |
|---|---|---|---|---|
| 6,056,571 | A | 5/2000 | Noro | |
| 7,270,567 | B2 | 9/2007 | Inoue | |
| 8,075,328 | B2 | 12/2011 | Ashibu | |
| 8,128,425 | B2 | 3/2012 | Takahashi et al. | |
| 8,298,001 | B2 * | 10/2012 | Ashibu | H01R 12/88 439/495 |

(Continued)

FOREIGN PATENT DOCUMENTS

| | | | |
|---|---|---|---|
| KR | 10-2010-0070898 | A | 6/2010 |
| KR | 10-2016-0088689 | A | 7/2016 |
| WO | WO 2008/004756 | A1 | 1/2008 |

OTHER PUBLICATIONS

International Search Report and Written Opinion dated Mar. 2, 2021 in connection with International Application No. PCT/SG2020/050676.

*Primary Examiner* — Ross N Gushi
(74) *Attorney, Agent, or Firm* — Wolf, Greenfield & Sacks, P.C.

(57) ABSTRACT

An electrical connector includes a housing, a plurality of contacts arranged in the housing, an actuator mounted to the housing and configured to move relative to the housing, and a locking terminal mounted to the housing, the locking terminal comprising a locking arm extending through an interior portion of the actuator and into a cavity within the housing, the cavity having an upper surface and a lower surface. Movement of the actuator relative to the housing may cause the interior portion of the actuator to push against at least part of the locking arm and rotate the at least part of the locking arm. When the actuator is in a first position, the locking arm may contact a surface of the cavity within the housing, which may inhibit the actuator from rotating in a first direction.

22 Claims, 10 Drawing Sheets

(56) References Cited

U.S. PATENT DOCUMENTS

| | | | |
|---|---|---|---|
| 8,864,512 | B2 | 10/2014 | Inomae |
| 9,525,226 | B2 | 12/2016 | Tamaki |
| 9,742,087 | B2 | 8/2017 | Tagami et al. |
| 9,859,639 | B2 | 1/2018 | Tagami et al. |
| 10,181,661 | B2 | 1/2019 | Manba |
| 10,305,209 | B2 | 5/2019 | Ishishita |
| 10,381,763 | B2 | 8/2019 | Ikegami |
| 10,566,721 | B2 | 2/2020 | Nakajima et al. |
| 2005/0260885 | A1 | 11/2005 | Lu |
| 2007/0155213 | A1 | 7/2007 | Shin |
| 2009/0068860 | A1 | 3/2009 | Suzuki et al. |
| 2017/0069989 | A1 | 3/2017 | Ashibu |
| 2020/0099148 | A1 | 3/2020 | Mizusawa et al. |
| 2020/0251842 | A1 | 8/2020 | Takane et al. |

* cited by examiner

Section L-L

Section M-M

Section J-J

Section C-C

FFC CONNECTOR WITH ANTI-OVERSTRESS FEATURES

CROSS-REFERENCE TO RELATED APPLICATIONS

The present application claims the benefit under 35 U.S.C. § 119(e) of U.S. Provisional Patent Application No. 62/939,458, filed Nov. 22, 2019, titled "FFC Connector with Anti-Overstress Features," which is hereby incorporated by reference in its entirety.

FIELD OF THE INVENTION

This disclosure relates generally to electrical interconnection systems and more specifically to electrical connectors with anti-overstress features.

BACKGROUND

Electrical connectors are used in many electronic systems. Various electronic devices (e.g., smart phones, tablet computers, desktop computers, notebook computers, digital cameras, and the like) have been provided with assorted types of connectors whose primary purpose is to enable an electronic component to exchange data, commands, or other signals with one or more other electronic components. Signal transmission to transfer information (e.g., data, commands, and/or other electrical signals) often utilizes electrical connectors to complete connections between electronic devices, between components of an electronic device, or between electrical systems that may include multiple electronic devices.

One or more of the connectors may be mounted to a printed circuit board. It is generally easier and more cost effective to manufacture an electrical system as separate electronic assemblies, such as printed circuit boards ("PCBs"), which may be communicatively joined with electrical connectors. In some scenarios, the PCBs to be joined may each have connectors mounted on them. The connectors on two PCBs may be mated directly to interconnect the PCBs.

In other scenarios, the PCBs may be connected indirectly via a cable or different locations on the same PCB may be connected via a cable. Electrical connectors may nonetheless be used to make such connections. For example, the cable may be terminated on one or both ends with a plug type of electrical connector ("plug" herein). A PCB may be equipped with a receptacle type of electrical connector ("receptacle" herein) into which the plug connector may be inserted to connect the cable to the PCB. A similar arrangement may be used at the other end of the cable, to connect the cable to another PCB, so that signals may pass between the PCBs via the cable.

In some cases, a flexible flat cable (FFC), sometimes called a flexible printed circuit (FPC), may be used to route signal between components on different PCB's or on the same PCB. To support such connections, FFC connectors or may be used to connect FFCs to PCBs. The FFC connector may be configured as a receptacle. Rather than receive a plug attached to the FFC, the receptacle may have contacts that mate to conductive pads attached to traces of the FFC, such that an end of the FFC might be inserted into the receptacle.

Some FFC receptacles include a locking mechanisms to lock the FFC in the receptacle, which may prevent the FFC from unintentional disconnection from the connector and may ensure a stable connections between the FFC and the PCB. The locking mechanism may be activated upon insertion of the FFC into the receptacle. The receptacle may include an actuator to release the FFC when desired.

SUMMARY

According to some aspects of the present technology, an electrical connector is provided comprising a housing configured to receive a mating component and comprising a mounting face and at least one internal surface, a plurality of contacts held in the housing, wherein the plurality of contacts comprise tails, configured for mounting to a printed circuit board, exposed at the mounting face, a latching member configured to engage a mating component inserted into the housing, an actuator movably coupled to the housing, wherein the actuator is coupled to the latching member and partially exposed outside of the housing, a locking terminal mounted to the housing, the locking terminal comprising a locking arm extending through a portion of the actuator and having a portion extending beyond the actuator, wherein the portion is between the at least one internal surface of the housing and the mounting face of the housing.

In an aspect, the at least one internal surface bounds a cavity within the housing, and the connector is configured such that, in a first position of the actuator, the portion of the locking arm extending beyond the actuator contacts a lower surface of the cavity.

In an aspect, the connector is configured such that, in a second position of the actuator, the portion of the locking arm extending beyond the actuator contacts the upper surface of the cavity within the housing.

In an aspect, the actuator comprises at least one stopping feature configured to contact the housing when the actuator is in the second position and to not contact the housing when the actuator is not in the second position.

In an aspect, the locking terminal further comprises a support arm mounted to the housing and configured to maintain a fixed position relative to the housing as the locking arm flexes.

In an aspect, the locking terminal is a first locking terminal and extends through a first end of the actuator, and the electrical connector further comprises a second locking terminal that extends through a second end of the actuator, the second end opposing the first end.

In an aspect, the latching member includes a curved surface proximate to the opening of the housing configured such that, when the mating component is inserted into the opening, the mating component pushes against the curved surface of the actuator latching member to cause the actuator to rotate.

In an aspect, a second position of the actuator is an open position, and the actuator is configured to move within the housing due to said pushing of the flat connecter against the curved surface of the actuator latching member when the actuator is in a closed position.

In an aspect, an electronic assembly comprises the connector in combination with a printed circuit board, wherein the tails of the plurality of contacts are soldered to the printed circuit board, the locking terminal comprises a base, with the locking arm extending from the base, and the base is soldered to the printed circuit board.

According to some aspects of the present technology, a method is provided of operating an electrical connector, comprising biasing a member comprising a first portion and a second portion and a third portion such that the second portion is in a first position blocking a portion of a slot in a housing for the connector, wherein the member is biased by a locking arm passing through the first portion, and applying a force to the third portion to rock the member about the first portion such that the second portion moves out of the first position and at least part of the first portion touches the locking arm and causes it to flex.

In an aspect, the first portion is disposed within a cavity of the housing and has an arcuate surface, and the member rocks by regions of the arcuate surface successively closer to the third portion contacting a floor of the cavity.

In an aspect, the first portion is constrained within the cavity as it rocks such that the member has a rotational component to its movement.

In an aspect, the method further comprises inserting a flat flexible circuit into the slot, and the second portion engages the flat flexible circuit when the second portion is in the first position.

In an aspect, inserting the flat flexible circuit into the slot comprises pressing an edge of the flat flexible circuit against second portion of the member so as to deflect the second portion from the first position.

In an aspect, the method further comprises limiting rocking of the member by butting a surface of the first portion against a surface of the housing.

In an aspect, the first portion comprises a first surface and a second surface making an acute angle with respect to the first surface and a rounded edge between the first surface and the second surface, rocking the member about the first portion comprises rolling the first portion on the rounded edge, and butting a surface of the first portion against a surface of the housing comprises butting the second surface against the surface of the housing.

In an aspect, the housing comprises a mounting face, the electrical connector further comprises a plurality of contacts held in the housing, the plurality of contacts comprise tails exposed at the mounting face and mounted to a printed circuit board, and the first surface of the first portion is parallel to the mounting face when the member is in the first position.

In an aspect, limiting rocking of the member by contacting a locking arm with a surface of the housing.

According to some aspects of the present technology, a method is provided of assembling an electrical connector, comprising inserting a first portion of a member into a cavity of a housing, wherein the housing comprises a slot configured to receive a flat flexible circuit, inserting a springy locking arm through a hole through the first portion of the member, and attaching a base of the locking arm to the housing such that the member is biased by the locking arm into a first position in which a second portion of the member blocks the slot.

In an aspect, the locking arm includes a portion within the housing that extends beyond the hole through the first portion of the member.

In an aspect, the portion of the locking arm is inserted into a cavity within the housing.

In an aspect, in the first position of the member, the portion of the locking arm extending beyond the hole through the first portion of the member contacts a lower surface of the cavity.

In an aspect, in a second position of the member in which the second portion of the member does not block the slot, the portion of the locking arm extending beyond the hole through the first portion of the member contacts an upper surface of the cavity.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

DETAILED DESCRIPTION

Figure 1A:
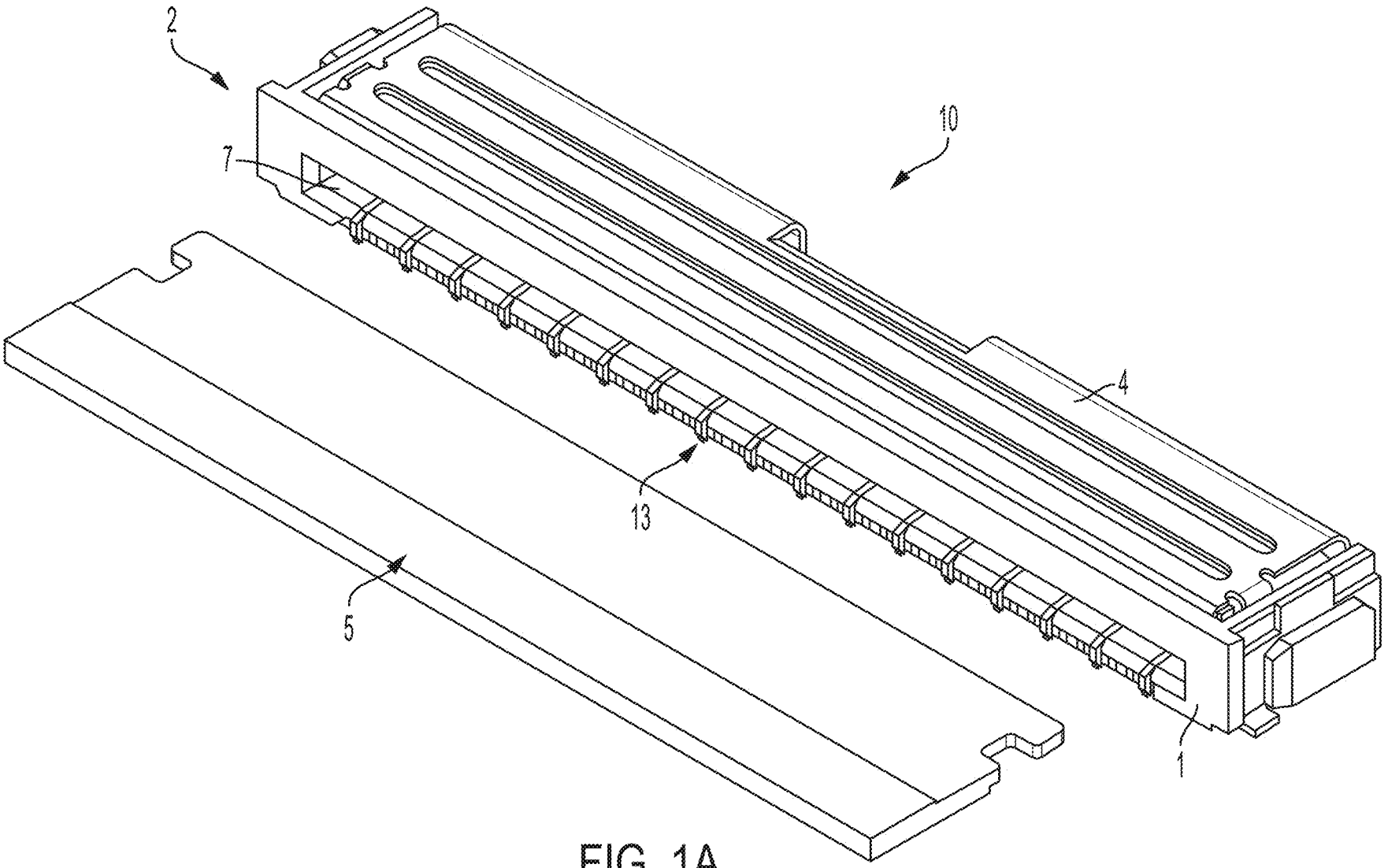
FIG. 1A PRIOR ART
FIG. 1A is a perspective view a receptacle and a flat cable to be connected to the circuit board connector.

The inventors have recognized and appreciated design techniques that enable a connector to be simply constructed while providing robust performance over its lifetime. These techniques may be applied to a receptacle that includes a member with a latches and an actuator exposed outside the receptacle to enable a user to release the latches. The member may be movably held to a receptacle housing in a way that enables simple construction techniques, but retains the actuator in position to latch and release a mating component inserted into the connector, such as an FFC.

The member may have first portions captured within cavities of the receptacle. The actuator and the latches may extend in opposite directions from the first portions such that motion of the actuator in one direction causes motion of the latches in the opposite direction. The member may be biased into a latched position, such that an FFC may be latched in the connector once inserted. The FFC may be released by depressing the actuator, which causes the latches to move such that the FFC may be withdrawn.

The actuator may be held in the housing with locking arms that pass through the first portions. Those locking arms may be springy and also provide the biasing force to urge the latching members into the latching position. The receptacle may have one or more features that prevent the locking arms from being overstressed, and therefore potentially damaged when the actuator or moved. Features may be included to prevent overstressing the locking arms either when a force is applied to the actuator in a direction that releases the FFC or in the opposite direction.

The inventors have further recognized and appreciated that, due to the compact size of some receptacle connectors, it may be easy for a user to unintentionally overstress elements of the connector. Moreover, the small structure of the connector may not provide sufficient resistance to this force to avoid damage. That is, it may be physically easy for a user to accidentally apply force that causes damage. Connector features as described herein may reduce or eliminate the possibility of damage to a receptacle connector, including both when the actuator is depressed by the user during an unmating operation or if force is applied to the actuator at other times, such as if the actuator is accidently pulled.

In some embodiments, an electrical connector may include an actuator movably coupled to a housing and a locking terminal mounted to the housing. The locking terminal may include a locking arm that extends through an interior portion of the actuator. The interior portion may for instance be a tunnel or chamber that is larger than the locking arm along at least one dimension, and may be arranged so that motion of the actuator (e.g., rocking or rotation) between open and closed positions may cause walls of the interior portion to push against the locking arm and cause the locking arm to also move. The locking terminal may include a fixed portion, such as a support arm, coupled to the locking arm, wherein the locking arm is free to deflect from a resting position when a suitable force is applied. In some cases, the locking arm may generate a spring force upon deflection while the fixed portion concurrently maintains a fixed position.

According to some embodiments, the locking arm may contact the interior portion of the actuator only when the actuator is in certain positions within its range of motion. For instance, the locking arm may have a resting position when the locking arm is not in contact with the interior portion of the actuator and, at some point during motion of the actuator, the interior portion of the actuator may begin to contact the locking arm. Further motion of the actuator in the same direction may thereby push the locking arm. When the actuator is moved back through this point in its motion, the locking arm may then cease contact with the interior portion of the actuator and return to its resting position. The above process may occur when the actuator moves in one direction, or may occur when the actuator moves in two different directions, with the locking arm contacting different portions of the interior portion of the actuator (e.g., an upper surface or a lower surface) depending on the direction of motion of the actuator.

According to some embodiments, at least part of the locking arm may be arranged within a cavity inside the housing such that the locking arm has a range of motion that is limited by the locking arm contacting one or more walls of the cavity. For instance, the locking arm may be free to rotate in a first direction until contacting an upper surface of the cavity, and the locking arm may be free to rotate in a second direction, opposite to the first direction, until contacting a lower surface of the cavity. According to some embodiments, the locking arm may also contact an interior portion of the actuator as described above. As a result, motion of the actuator may cause the locking arm to move and to thereby reach a limit of its range of motion produced by the one or more walls of the cavity. Inversely, when the locking arm has reached this limit in its range of motion, the actuator may also have reached a corresponding limit in its range of motion, because further motion of the actuator would cause the interior portion of the actuator to push on the locking arm, but the locking arm may be unable to move further because it is braced against the one or more walls of the cavity.

According to some embodiments, the actuator of the connector may be arranged to contact one or more stopping features of the housing at a position in which the locking arm has also reached a limit in its range of motion. Such stopping features may provide a further force to act against motion of the actuator beyond its intended range of motion.

Illustrative examples of some of the above-described electrical connectors are illustrated in the figures, described below.

FIG. 1A depicts a perspective view of a typical receptacle and flat cable (e.g., a flexible printed circuit (FPC) connector and/or a flexible flat cable (FFC)) to be inserted into the receptacle, for purposes of illustration. Receptacle 10 comprises a housing 1 which has a slot 7 opening to a front side 2 of housing 1. Slot 7 is to receive a flat cable 5 into housing 1 to establish an electrical connection between the flat cable 5 and signal contacts of the receptacle 10, of which signal contact 13 is one example. Receptacle 10 includes an actuating member 4 coupled to housing 1, which may be moved to adjust the receptacle between locked and unlocked positions, wherein the unlocked position allows for insertion and removal of the flat cable into the housing, and the locked position restricts the flat cable from being removed from the housing after insertion. In some embodiments, actuating member 4 is comprised of metal and serves a shielding function.

Figure 1B:
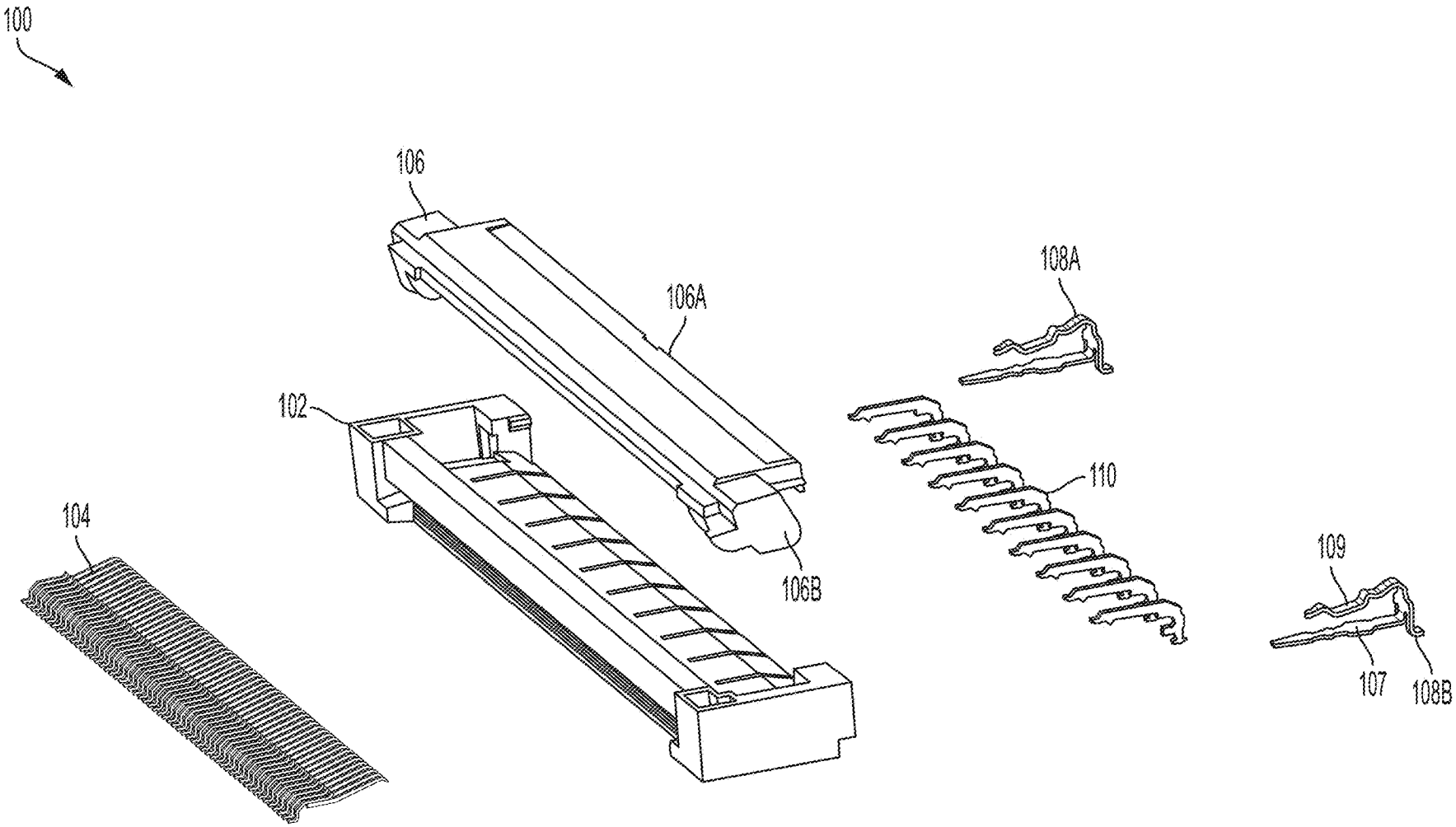
FIG. 1B is an exploded view of an illustrative electrical connector, according to some embodiments.

Referring to FIG. 1B, components of an illustrative electrical connector are depicted in an exploded view, according to some embodiments. In the example of FIG. 1B, a housing 102 is provided and is configured to have the remaining components mounted to it. These components include terminals 104, member 106, locking terminals 108A and 108B, and ground contacts 110. The illustrative receptacle type electrical connector 100 is configured to receive a flat cable, which is inserted into the receptacle opening of the housing and thereby makes contact with the terminals 104 on a lower side of the connector, and the ground contacts 110 on an upper side of the connector. The member 106 includes one or more rockers 106B arranged to move within the housing, and one or more latching members to lock with a feature of the flat cable when the connector is inserted into the housing 102 of electrical connector 100. For instance, an FPC or FFC connector may include an indent, hole or other mateable feature with which a latching member portion of the member may be coupled after insertion of the FPC/FFC connector into the housing 102. The member 106 also includes an actuator 106A that may be exposed outside of the housing 102 and that may be pushed on by a user to engage and disengage the latching member(s).

Locking terminals 108A and/or 108B may hold the member 106 within the housing 102 and may provide a biasing force to the member to bias the member into a latched position (i.e., with the one or more latching members engaged in the opening of the housing). As discussed above, however, the locking terminals may pass through portions of the actuator 106A and that are inhibited from being overstressed by features of the housing. The locking terminals may be arranged such that motion of the actuator causes motion (e.g., flexing) of part of either or both of the locking terminals. In particular, the illustrative locking terminal 108B includes a locking arm 109 and a support arm 107. The locking arm 109 may be free to flex relative to the support arm 107. The support arm 107 may be mounted within the housing 102 in a substantially fixed position. In some cases, the locking terminals may include a tail which may be soldered to a circuit board, such as a PCB, along with the ground contacts 110.

Conductive terminals 104 may be configured based on the flat cable to be inserted into the electrical connector 100. For instance, the number of terminals may be selected based on the number of terminals arranged on a corresponding FPC/FFC connector. Any number of ground contacts 110 may be provided, as in some cases a corresponding FPC/FFC connector may include a single ground contact to which the contacts 110 may connect when the connectors are coupled together. The ground contacts 110 may be soldered to a circuit board, such as a PCB, as discussed further in relation to FIG. 7 below.

FIGS. 2A-2D depicts the illustrative electrical connector 100 as assembled, and depict a front view of the connector (FIG. 2A) in addition to three cross-sectional views through the connector (FIGS. 2B-2D), according to some embodiments. As shown in the example of FIGS. 2A-2D, the electrical connector 100 includes a slot 101 into which a flat cable may be inserted (e.g., in a direction going into the page in the example of FIG. 2A's front view). The flat cable may make contact, when inserted, with the terminals 104 on a first side and with ground contacts 110 on a second side. The member 106, shown in FIGS. 2A-2D with the actuator in a closed position, includes two latching members 112, which may each be inserted through respective notches in the flat cable to hold the cable in place after its insertion into the electrical connector 100.

Figure 2A:
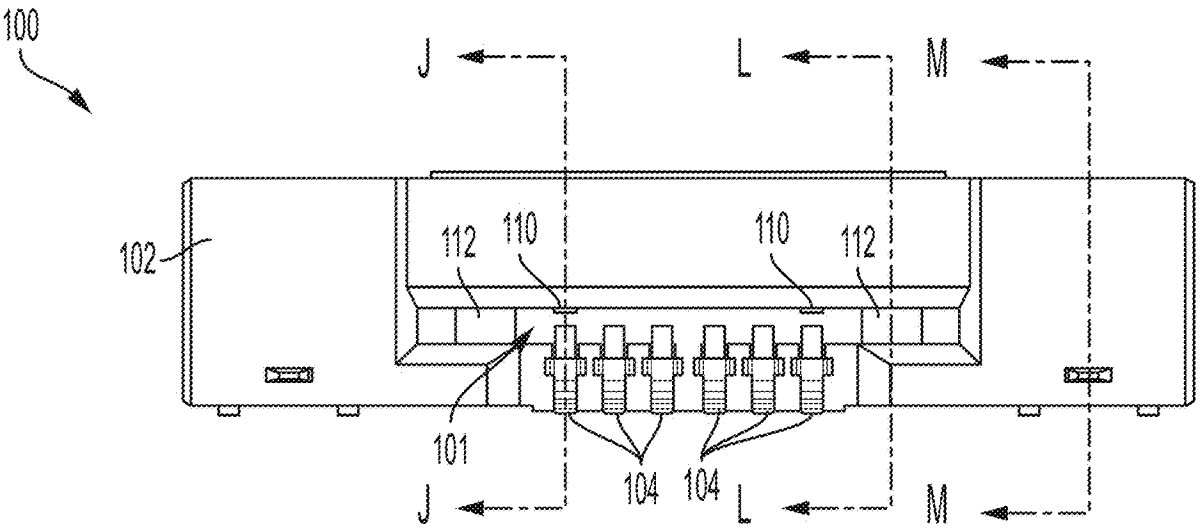
FIG. 2A is a front view depicting the illustrative electrical connector of FIG. 1B, according to some embodiments.
Figure 2C:
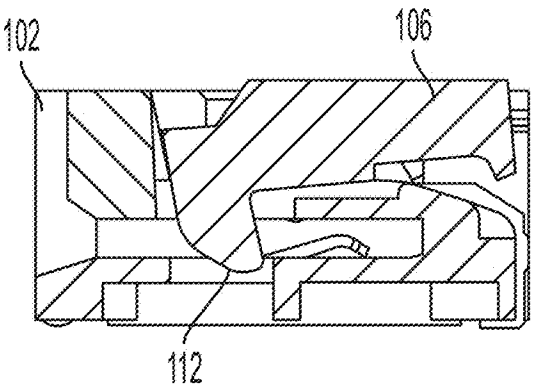
FIGS. 2B, 2C and 2D are cross-sectional views through the connector of FIG. 2A, taken along lines J-J, L-L and M-M, respectively.
Figure 2D:
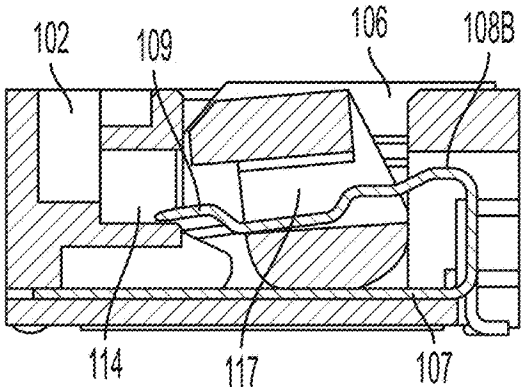
Figure 2B:
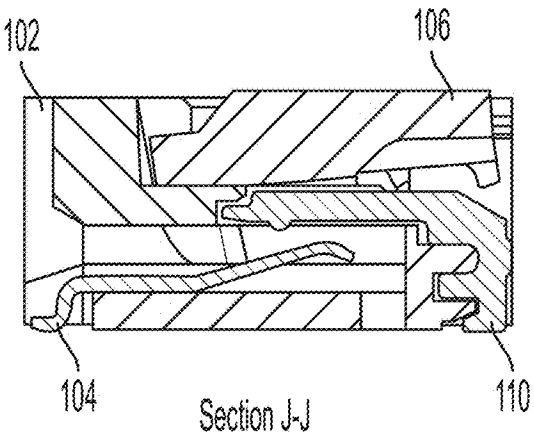

Referring to the cross-sectional view of FIG. 2B, which shows a view through the cross-section marked J-J in front view FIG. 2A, an insertion space interior to slot 101 may be seen with illustrative instance of terminals 104 extended within the housing. An illustrative ground contact 110 is arranged above the insertion space. It may be noted that a portion of terminals 104 may be arranged to flex downwards upon insertion of a flat cable. The spring force of the terminals when flexed in this manner may produce (or may help to produce) an electrical connection between the terminals and conductive regions of the flat cable (e.g., pads) inserted into the connector 100. As shown in FIG. 2B, the terminals 104 extend into the insertion space but include a tip portion that may be flexed downward when the terminal is pushed on from the slot side of the electrical connector 100 by a flat cable being inserted.

Referring to the cross-sectional view of FIG. 2C, which shows a view through the cross-section marked L-L in front view FIG. 2A, the member 106 includes a latching member 112 which, when the actuator is in the closed position pictured in FIGS. 2A-2D, may be inserted through a notch or other feature within an inserted flat cable. In the example of FIGS. 2A-2D, the latching member 112 includes a curved face on the slot side of the electrical connector 100, which may aid in moving (e.g., rotating) the actuator of member 106 into an open position (clockwise as illustrated). For example, a flat cable being inserted into the electrical connector may push against the latching member 112 when the actuator of member 106 is in the illustrated closed position, or has been rotated slightly clockwise from the closed position. Due to the curved face of the latching member, manual movement (e.g., rotation) of the actuator of member 106 in the clockwise direction may not produce any substantial back force against the flat cable, thereby improving the ease of insertion.

Referring to the cross-sectional view of FIG. 2D, which shows a view through the cross-section marked M-M in front view FIG. 2A, the housing 102 includes a receiving cavity 114 which, in the example of FIGS. 2A-2D, has a roughly square cross-sectional shape. The locking terminal 108B includes locking arm 109, the tip of which extends into the cavity 114. Moreover, member 106 includes an interior portion 117, through which the locking arm 109 of the locking terminal 108B extends. It may be noted that flexure of the locking arm 109 may be limited by a tip (or other distal region) of the locking arm contacting the upper or lower surface of the cavity 114. Moreover, it may be noted that the locking arm 109 and the interior portion 117 of the member 106 are shaped such that movement (e.g., rotation, rocking) of the actuator may cause the locking arm to contact a wall of the interior portion, for at least some positions of the actuator. As such, movement of the actuator may cause flexure of the locking arm, thereby producing the bias force discussed above.

Figure 3A:
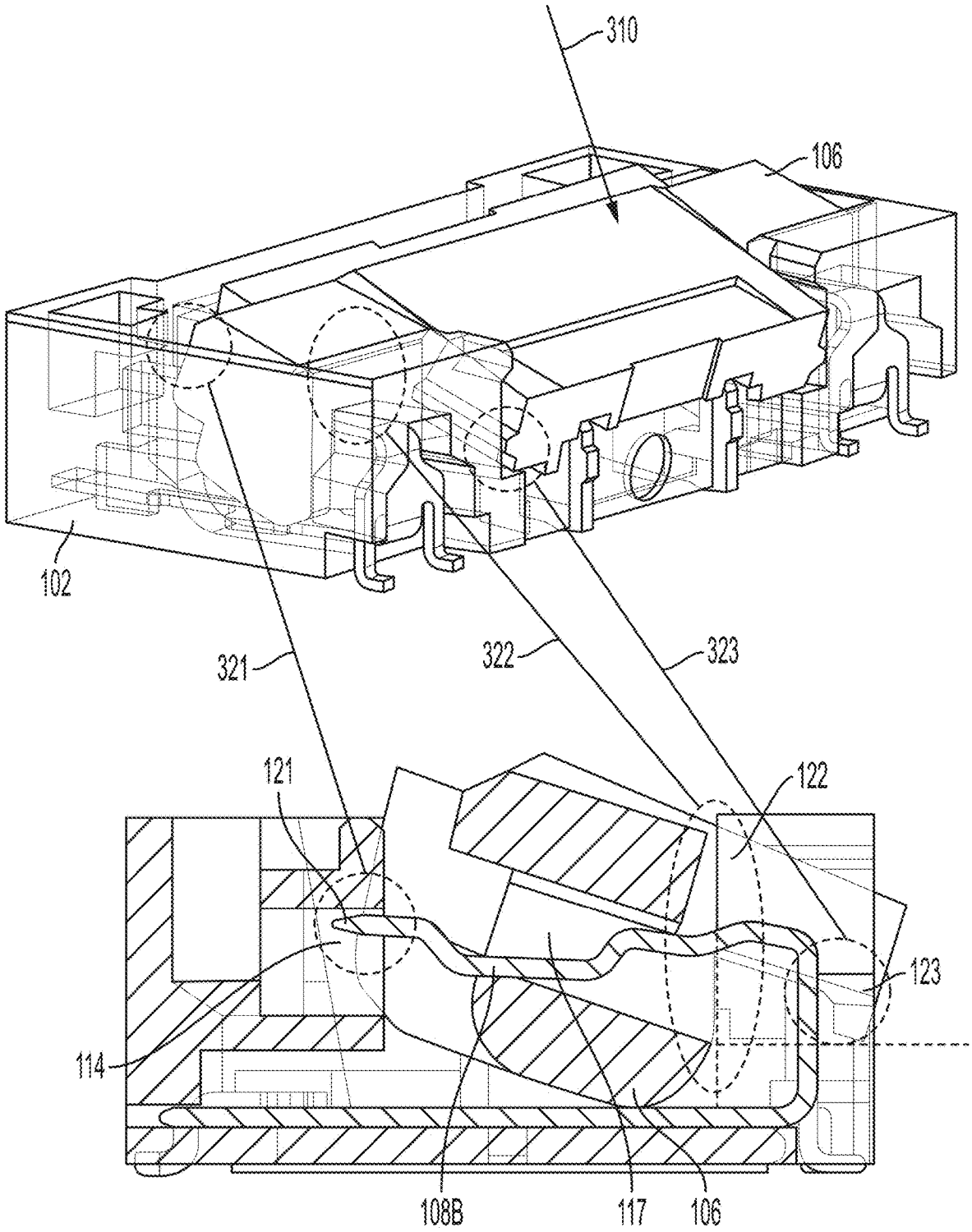
FIGS. 3A-3B depict a perspective and side view, respectively, of the illustrative electrical connector of FIG. 1B highlighting anti-overstress features when in an open position, according to some embodiments.
Figure 3B:
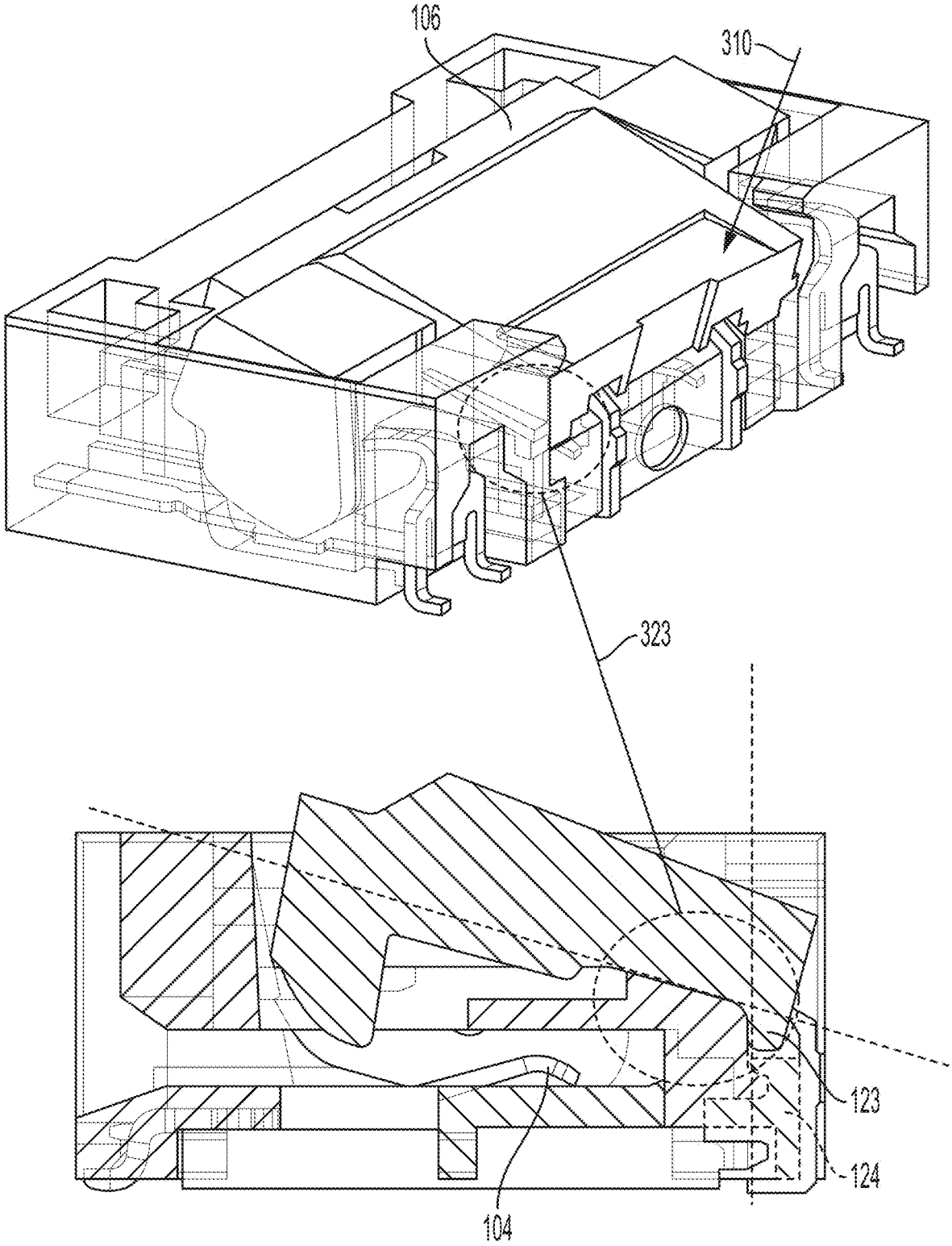
Figure 4A:
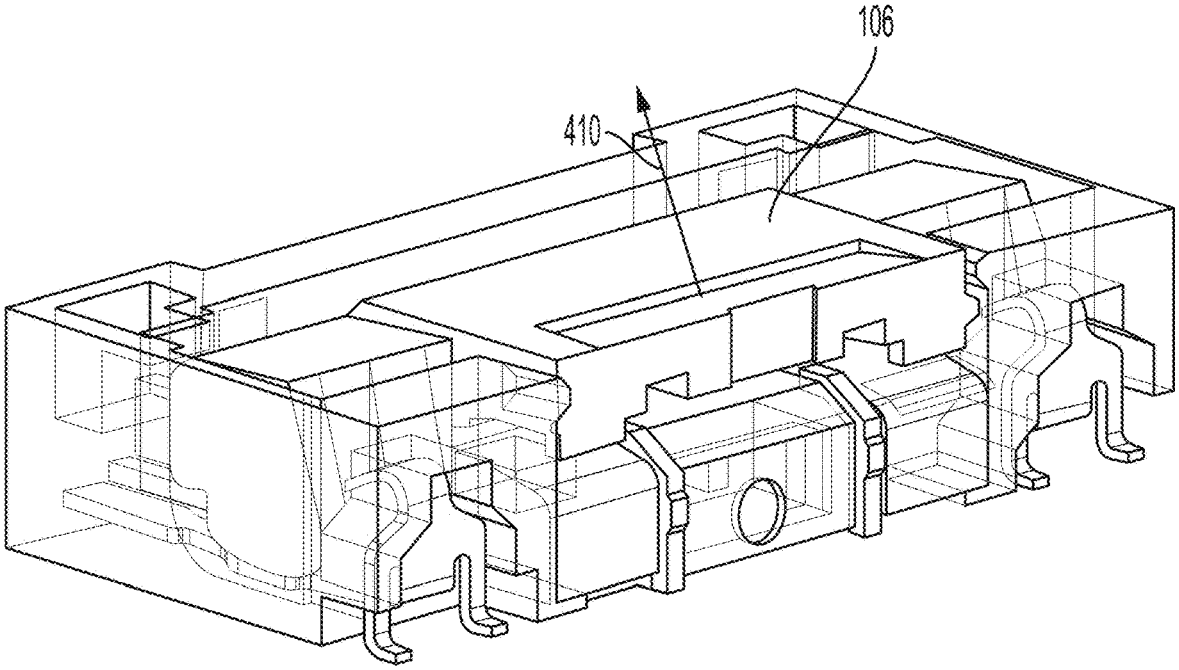
FIGS. 4A-4C depict the illustrative electrical connector of FIG. 1B highlighting anti-overstress features when in a closed position, according to some embodiments.
Figure 4B:
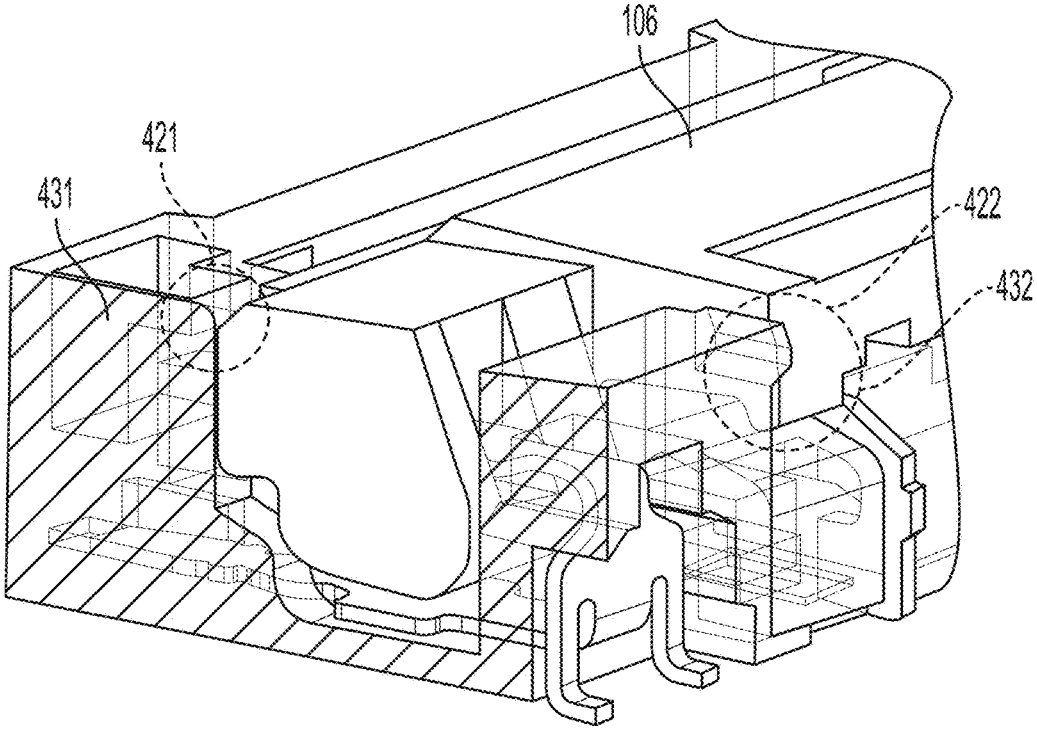
Figure 4C:
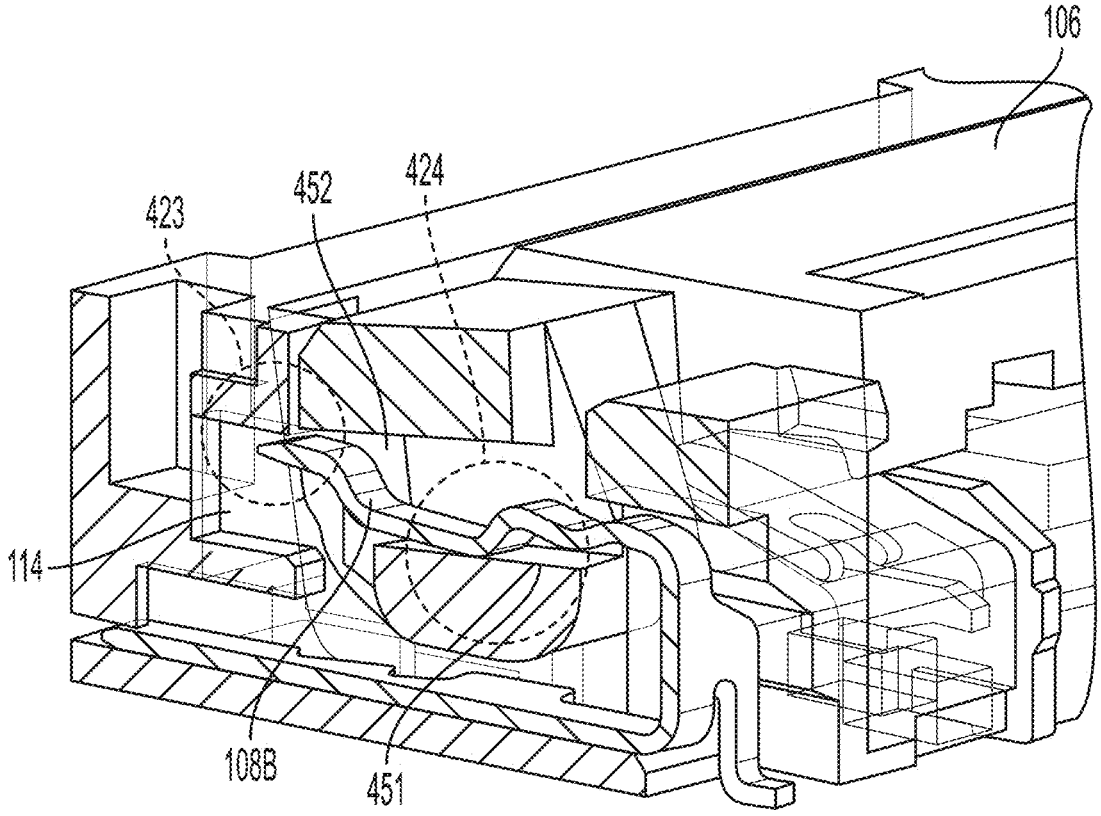

Further illustrations of the anti-overstress features of the electrical connector described herein are shown in FIGS. 3A-3B and in FIGS. 4A-C, with FIGS. 3A-3B illustrating possible overstress through attempted motion of the actuator through and beyond the open position, and FIGS. 4A-4C illustrating possible overstress through attempted motion of the actuator through and beyond the closed position.

With respect to FIG. 3A, according to some embodiments, the electrical connector is shown in a perspective view and a side view through a cross section comprising the locking terminal 108B (e.g., corresponding to cross section M-M of FIG. 2). The actuator of member 106A is illustrated in the open position, with a force 310 being applied to push the actuator further in the clockwise direction shown in the side view of FIG. 3A. In the example of FIG. 3A, three points within the electrical connector are circled within each view as including a feature that prevents overstress that might be caused by force 310 being applied to move the actuator beyond its fully open state. These features are highlighted with dashed circles in each view and labeled 321, 322 and 323.

In the example of FIG. 3A, feature 321 is a tip 121 of the locking arm of locking terminal 108B, which contacts the upper surface of cavity 114 of the housing. It may be noted that the locking arm is braced against the interior portion 117 of the actuator such that further clockwise motion of the actuator would cause the tip to push against the upper surface of the cavity 114. As such, the tip 121 of the locking arm may provide resistance against the illustrated type of overstress of the actuator.

In the example of FIG. 3A, anti-overstress feature 322 comprises a first stopping feature 122 of the member 106 which is incident upon a vertical structure of the housing in the position shown in FIG. 3A. Thus, in this position, the first stopping feature 122 is braced against a portion of the housing 102. As such, the housing and first stopping feature 122 provide resistance against the illustrated type of overstress of the actuator. Furthermore, anti-overstress feature 323 comprises a second stopping feature 123 of the member 106 which is incident upon a vertical structure of the housing in the position shown in FIG. 3A. Thus, in this position, the second stopping feature 123 is braced against a portion of the housing 102. As such, the housing and second stopping feature 123 provide resistance against the illustrated type of overstress of the actuator.

The second stopping feature 123 is illustrated further in FIG. 3B, which depicts a side view through a cross section comprising the second stopping feature 123 (e.g., corresponding to cross section L-L of FIG. 2). In FIG. 3B, the same force 310 is being applied as in FIG. 3A, but a different cross-section through the electronic connector is shown. The member 106 includes the second stopping feature 123 which contacts a portion 124 of the housing 102 in the illustrated open configuration.

As shown in FIG. 3B, the stopping feature 123 of member 106 may include a protruding surface that extends downward from the body of the member and which contacts an upper-facing surface of an interior of the housing when the actuator is fully open to inhibit the actuator from being move beyond the open position. In the particular example of FIG. 3B, the stopping feature 123 has a lower surface angled with respect to the actuator such that when the actuator is arranged in the open position the lower surface is horizontal and contacts the horizontal upper surface of the portion 124 of the housing. Thus, the stopped feature 123 may have a lower surface that is angled with respect to the actuator at an angle equal to (or substantially equal to), the angle the actuator makes with respect to the housing when in the open position.

With respect to FIGS. 4A-4C, according to some embodiments, the electronic connector is shown in perspective view in FIG. 4A in a closed position, with FIGS. 4B and 4C providing cutaway perspective views of anti-overstress features 421-424 of the connector. In the example of FIGS. 4A-4C, a force 410 is applied to push the actuator further in the direction of the closed position shown. Four points within the electrical connector are circled within each view as including a feature that prevents overstress that might be caused by force 410 being applied to move the actuator beyond its fully closed state. Such a force may be, for instance, produced in an unintended operating state, such as if another object accidentally snags on the actuator and pushes the actuator in the closing direction. These features are highlighted with dashed circles in each view and labeled 421, 422, 423 and 424.

As shown in FIG. 4B, anti-overstress feature 421 is a front portion of the actuator that is incident upon a portion 431 of the housing 102 when the actuator is the in the illustrated closed position. Anti-overstress feature 422 is a rear portion of the actuator that is incident upon a portion 432 of the housing 102 when the actuator is the in the illustrated closed position. The housing portions 431 and 431 and corresponding portions of the actuator thereby provide resistance against the illustrated type of overstress of the actuator.

As shown in FIG. 4C, anti-overstress features 423 and 424 comprise regions of the locking terminal 108B that restrict the member 106 from moving (e.g., rocking or rotating) further counterclockwise from the closed position. In particular, the shape of the interior portion 117 of the member 106 and the locking arm 109 are such that the actuator is unable to move around the locking arm any further, because the actuator is braced at the positions marked 423 and 424. For instance, further motion of the actuator may cause the rear portion 451 of the actuator to push up on the rear part of the locking arm and cause the locking arm to flex upwards. However, the same motion of the actuator may cause front portion 452 of the actuator to simultaneously push down on the front part of the locking arm and cause the locking arm to flex downwards. The combination of these motions are such that the actuator may be unable to move around the locking arm in a counterclockwise direction beyond the depicted close position.

In some embodiments, in addition or alternatively to bracing of the actuator against the locking arm shown in FIG. 4C, the tip of the locking arm may touch the lower surface of cavity 114 inside the housing such that further counterclockwise motion (e.g., rotation, rocking) of the actuator would cause the tip to push against the lower surface of the cavity 114. As such, the tip 121 of the locking arm may provide resistance against the illustrated type of overstress of the actuator.

Figure 5:
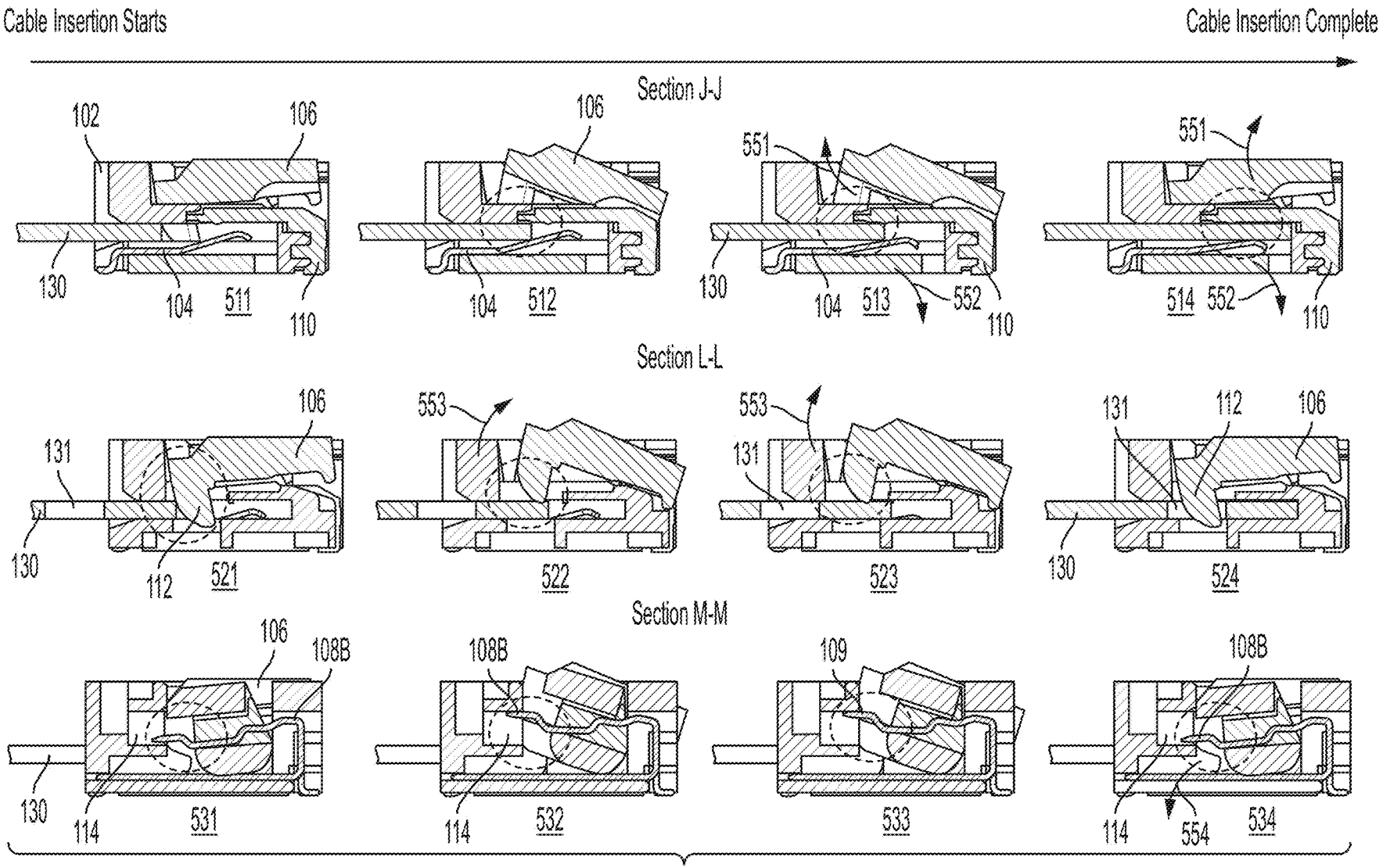
FIG. 5 illustrates a sequence in which an FFC is inserted into the illustrative electrical connector of FIG. 1B, according to some embodiments.

FIG. 5 illustrates a sequence in which a flat cable is inserted into the electronic connector 100, according to some embodiments. In FIG. 5, the cable insertion sequence is depicted running left to right for each of the three cross-sections shown in FIG. 2. That is, views 511, 512, 513 and 514 depict an insertion sequence, in that order, for cross-section J-J; views 521, 522, 523 and 524 depict an insertion sequence, in that order, for cross-section L-L; and views 531, 532, 533 and 534 depict an insertion sequence, in that order, for cross-section M-M.

In an initial step, as shown by views 511, 521 and 531, a flat cable 130, illustrated in the example of FIG. 5 as an FFC, begins to be inserted into the electronic connector. At this step, the member 106 begins to move clockwise (e.g., rock or rotate) due at least in part to force applied by the flat cable 130 being inserted and pushing against the latching member 112 as shown in view 521. Moreover, the locking arm of the locking terminal 108B, shown in an initial position in view 531, may begin to be deflected upwards by the interior portion of the actuator as the actuator begins to move.

In a subsequent step, as shown by views 512, 522 and 532, the member 106 begins to rotate upward (and may also rock or otherwise move in addition to the rotation) while the locking arm of the locking terminal 108B also rotates upward. In some cases, depending on the location of contacts on the cable 130, the terminals 104 may begin to make contact with contacts on the underside of the cable as shown by the dashed circle in view 512.

In a subsequent step, as shown by views 513, 523 and 533, the ground contacts 110 may begin to make contact with contacts on the upper side of the cable as shown by the dashed circle in view 513. Moreover, the member 106 may reach the extent of its upward motion, wherein the tip of locking arm 109 prevents, at least in part, further rotation and/or overstress of the actuator as shown by the dashed circle in view 533.

In a subsequent step, as shown by views 514, 524 and 534, the latching member 112 of member 106 is inserted into a notch 131 in the cable 130. In some embodiments, the latching member of the actuator may be inserted into the notch as a result of gravity acting on the actuator, causing the actuator to drop into the notch. The combination of the latching member holding the cable in place and the flexed terminals 104 and ground contacts 110 holding the cable in place may allow the cable to be securely mated with the electrical connector 100.

Figure 6:
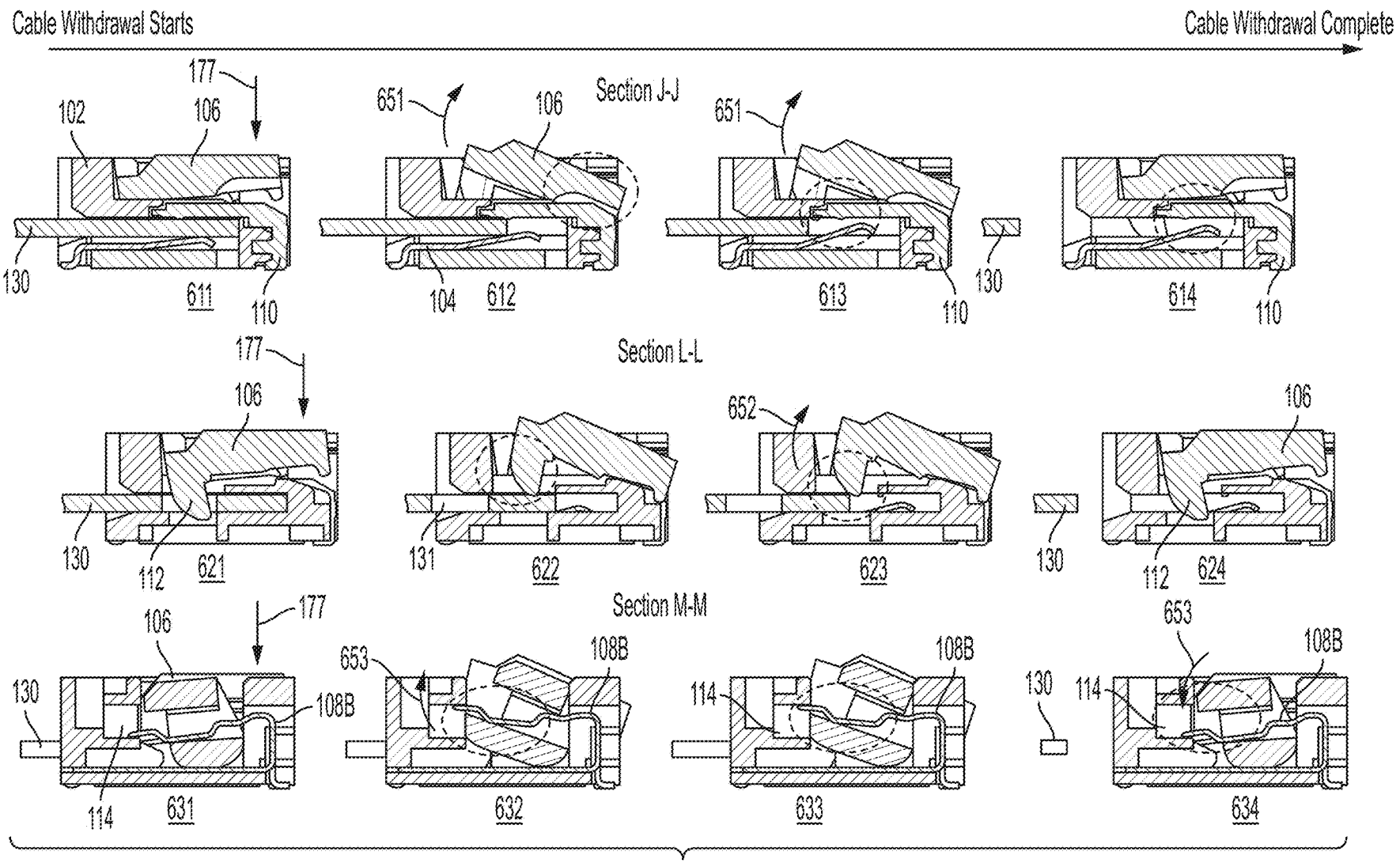
FIG. 6 illustrates a sequence in which an FFC is withdrawn from the illustrative electrical connector of FIG. 1B, according to some embodiments.

FIG. 6 illustrates a sequence in which a flat cable is removed from the electronic connector 100, according to some embodiments. In FIG. 6, the cable insertion sequence is depicted running left to right for each of the three cross-sections shown in FIG. 2. That is, views 611, 612, 613 and 614 depict an insertion sequence, in that order, for cross-section J-J; views 621, 622, 623 and 624 depict an insertion sequence, in that order, for cross-section L-L; and views 631, 632, 633 and 634 depict an insertion sequence, in that order, for cross-section M-M.

In an initial step, as shown by views 611, 621 and 631, member 106 begins to be rotated clockwise due to application of force 177 on the actuator portion of the member. This force may be produced by the finger of a user or otherwise. In a subsequent step, as shown by views 612, 622 and 632, the actuator reaches the open position, and is restricted from opening further and/or producing undue stress by the anti-overstress features discussed above and circled in views 612, 622 and 632.

In a subsequent step, as shown by views 613, 623 and 633, the cable 130 is withdrawn from the electronic connector while the actuator of member 106 is held in the open position. In a subsequent step, as shown by views 614, 624 and 634, the actuator is released to a closed position. As noted by the dashed circle in view 634, the locking arm returns to a resting state with the tip of the locking arm touching the lower face of cavity 114.

Figure 7A:
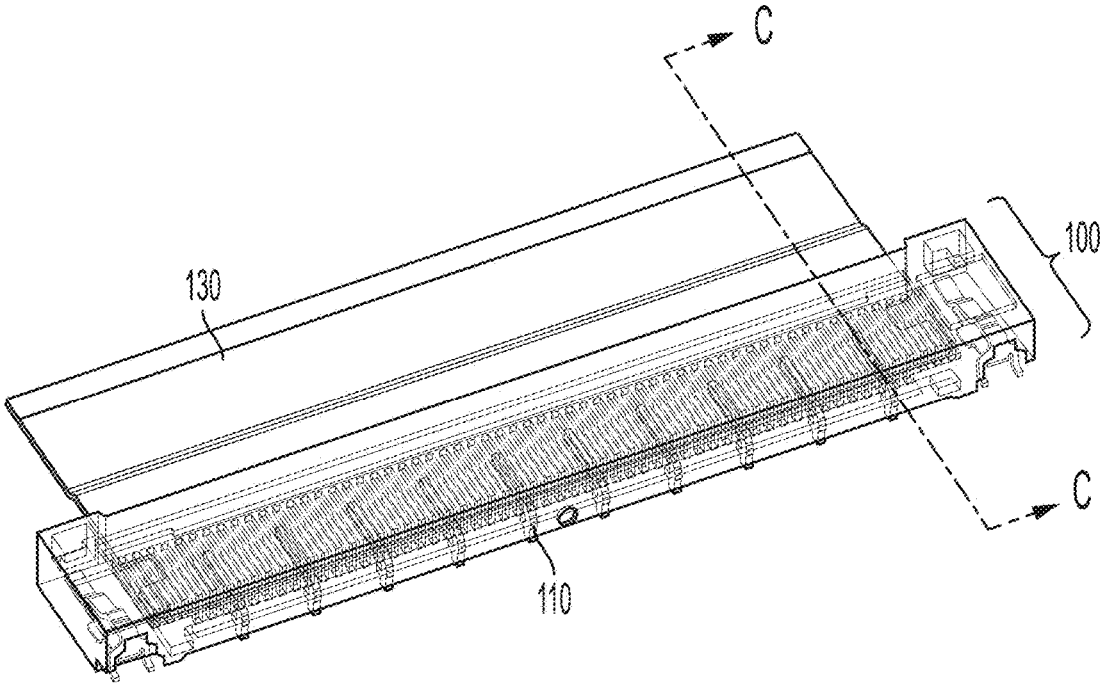
FIGS. 7A-7B depict views of an FFC inserted into the illustrative electrical connector of FIG. 1B, according to some embodiments.
Figure 7B:
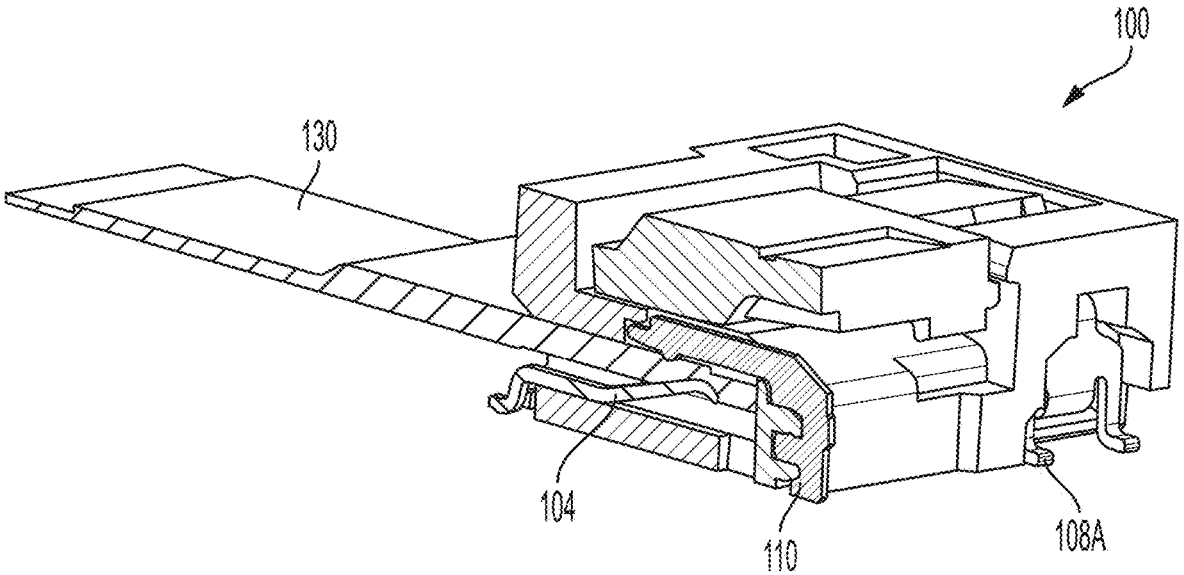

FIG. 7A depicts a perspective view of a flat cable 130 inserted into electronic connector 100, according to some embodiments. In the example of FIG. 7A, the electronic connector 100 is shown as a wireframe to more clearly show how the cable is situation when coupled to the connector. FIG. 7B depicts a perspective view of the cable 130 and electronic connector 100 through cross-section C-C shown in FIG. 7A. As may be noted, the cable 130 is arranged between the ground contact 110 and the terminal 104, with the terminal 104 flexed. The ground contacts 110 and the terminals 104 may be, for example soldered to a PCB on which the electronic connector 100 is arranged. In some embodiments, a portion of the locking terminal 108A may also be soldered to the PCB.

It should be understood that various alterations, modifications, and improvements may be made to the structures, configurations, and methods discussed above, and are intended to be within the spirit and scope of the invention disclosed herein. Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

What is claimed is:

1. An electrical connector comprising:

a housing configured to receive a mating component and comprising a mounting face and at least one internal surface;

a plurality of contacts held in the housing, wherein the plurality of contacts comprise tails, configured for mounting to a printed circuit board, exposed at the mounting face;

a latching member configured to engage a mating component inserted into the housing;

an actuator movably coupled to the housing, wherein the actuator is coupled to the latching member and partially exposed outside of the housing; and a locking terminal mounted to the housing, the locking terminal comprising a locking arm extending through a portion of the actuator and having a portion extending beyond the actuator, wherein the portion extending beyond the actuator is between the at least one internal surface of the housing and the mounting face of the housing.

2. The electrical connector of claim 1, wherein:

the at least one internal surface bounds a cavity within the housing; and the connector is configured such that, in a first position of the actuator, the portion of the locking arm extending beyond the actuator contacts a lower surface of the cavity.

3. The electrical connector of claim 2, wherein:

the connector is configured such that, in a second position of the actuator, the portion of the locking arm extending beyond the actuator contacts the upper surface of the cavity within the housing.

4. The electrical connector of claim 3, wherein:

the actuator comprises at least one stopping feature configured to contact the housing when the actuator is in the second position and to not contact the housing when the actuator is not in the second position.

5. The electrical connector of claim 1, wherein the locking terminal further comprises a support arm mounted to the housing and configured to maintain a fixed position relative to the housing as the locking arm flexes.

6. The electrical connector of claim 1, wherein:

the locking terminal is a first locking terminal and extends through a first end of the actuator, and the electrical connector further comprises a second locking terminal that extends through a second end of the actuator, the second end opposing the first end.

7. The electrical connector of claim 1, wherein the latching member includes a curved surface proximate to the opening of the housing configured such that, when the mating component is inserted into the opening, the mating component pushes against the curved surface of the actuator latching member to cause the actuator to rotate.

8. The electrical connector of claim 7, wherein a second position of the actuator is an open position, and wherein the actuator is configured to move within the housing due to said pushing of the flat connecter against the curved surface of the actuator latching member when the actuator is in a closed position.

9. An electronic assembly comprising a connector as in claim 1 in combination with a printed circuit board, wherein:

the tails of the plurality of contacts are soldered to the printed circuit board;

the locking terminal comprises a base, with the locking arm extending from the base; and the base is soldered to the printed circuit board.

10. A method of operating an electrical connector, comprising:

biasing a member comprising a first portion and a second portion and a third portion such that the second portion is in a first position blocking a portion of a slot in a housing for the connector, wherein the member is biased by a locking arm passing through the first portion; and applying a force to the third portion to rock the member such that the second portion moves out of the first position and at least part of the first portion touches the locking arm and causes it to flex, wherein:

the first portion is disposed within a cavity of the housing and has an arcuate surface; and the member rocks by regions of the arcuate surface successively closer to the third portion contacting a floor of the cavity.

11. The method of claim 10, wherein:

the first portion is constrained within the cavity as the member rocks such that the member has a rotational component to its movement.

12. The method of claim 10, wherein:

the method further comprises inserting a flat flexible circuit into the slot; and the second portion engages the flat flexible circuit when the second portion is in the first position.

13. The method of claim 12, wherein:

inserting the flat flexible circuit into the slot comprises pressing an edge of the flat flexible circuit against second portion of the member so as to deflect the second portion from the first position.

14. The method of claim 10, further comprising:

limiting rocking of the member by contacting a locking arm with a surface of the housing.

15. A method of operating an electrical connector, comprising:

biasing a member comprising a first portion and a second portion and a third portion such that the second portion is in a first position blocking a portion of a slot in a housing for the connector, wherein the member is biased by a locking arm passing through the first portion;

applying a force to the third portion to rock the member such that the second portion moves out of the first position and at least part of the first portion touches the locking arm and causes it to flex; and limiting rocking of the member by butting a surface of the first portion against a surface of the housing.

16. The method of claim 15, further wherein:

the first portion comprises a first surface and a second surface making an acute angle with respect to the first surface and a rounded edge between the first surface and the second surface;

rocking the member about the first portion comprises rolling the first portion on the rounded edge; and butting a surface of the first portion against a surface of the housing comprises butting the second surface against the surface of the housing.

17. The method of claim 15, further wherein:

the housing comprises a mounting face;

the electrical connector further comprises a plurality of contacts held in the housing, wherein the plurality of contacts comprise tails exposed at the mounting face and mounted to a printed circuit board; and the first surface of the first portion is parallel to the mounting face when the member is in the first position.

18. A method of assembling an electrical connector, comprising:

inserting a first portion of a member into a cavity of a housing, wherein the housing comprises a slot configured to receive a flat flexible circuit;

inserting a springy locking arm through a hole through the first portion of the member; and attaching a base of the locking arm to the housing such that the member is biased by the locking arm into a first position in which a second portion of the member blocks the slot.

19. The method of claim 18, wherein the locking arm includes a portion within the housing that extends beyond the hole through the first portion of the member.

20. The method of claim 19, wherein the portion of the locking arm is inserted into a cavity within the housing.

21. The method of claim 20, wherein in the first position of the member, the portion of the locking arm extending beyond the hole through the first portion of the member contacts a lower surface of the cavity.

22. The method of claim 20, wherein in a second position of the member in which the second portion of the member does not block the slot, the portion of the locking arm extending beyond the hole through the first portion of the member contacts an upper surface of the cavity.

* * * * *